US008558700B2

(12) United States Patent
Chen

(10) Patent No.: US 8,558,700 B2
(45) Date of Patent: Oct. 15, 2013

(54) RFID-BASED ELECTRIC SEAL

(76) Inventor: Chih Chuan Chen, Nantou (TW)

( * ) Notice: Subject to any disclaimer, the term of this patent is extended or adjusted under 35 U.S.C. 154(b) by 504 days.

(21) Appl. No.: 12/928,054

(22) Filed: Dec. 2, 2010

(65) Prior Publication Data

US 2012/0139699 A1 Jun. 7, 2012

(51) Int. Cl.
*G08B 21/00* (2006.01)

(52) U.S. Cl.
USPC ..... 340/572.8; 340/5.61; 340/572.7; 29/282

(58) Field of Classification Search
USPC ..... 29/282; 340/572.8, 5.61; 292/307 R; 70/181, 50, 57, 57.1, 58
See application file for complete search history.

(56) References Cited

U.S. PATENT DOCUMENTS 7,298,274 B2 11/2007 Chen et al.

*Primary Examiner* — Daniel Wu
*Assistant Examiner* — Frederick Ott
(74) *Attorney, Agent, or Firm* — Charles E. Baxley

(57) ABSTRACT

An electric seal includes a lock member having a compartment and an orifice communicative with each other and having a spring blade, a latch device engaged in the lock member, an antenna device having a segment engaged with the spring blade, a lock shaft engageable through the orifice and into the compartment of the lock member and lockable to the lock member with the latch device, and a circuit board attached to the lock shaft and having an RFID chip coupled to an electric circuit, the electric circuit includes a contact for selectively engaging with the upper segment of the antenna device and for electrically connecting the electric circuit to the antenna device when the lock shaft is engaged into the orifice of the lock member.

14 Claims, 9 Drawing Sheets

RFID-BASED ELECTRIC SEAL

BACKGROUND OF THE INVENTION

1. Field of the Invention

The present invention relates to an electric lock or seal, and more particularly to a radio frequency identification (RFID)-based electric lock or seal using RFID technology to secure and to identify containers or other objects, and including an improved structure for allowing the electric lock or seal to be easily and quickly manufactured and assembled and for suitably decreasing the manufacturing cost for the electric lock or seal.

2. Description of the Prior Art

Typical RFID-based electric locks or seals comprise a complicated structure including a number of parts or elements that are required to be manufactured separated and are then required to be assembled together.

For example, U.S. Pat. No. 7,298,274 to Chen et al. discloses one of the typical passive RFID-based electric locks or seals comprising a complicated structure including a lower body and an upper body, an upper sleeve, a central sleeve, and a lower sleeve, two antennas, an RFID chip, and two sockets that are required to be made or manufactured separated and then required to be assembled together.

However, the great number of parts or elements may not be easily manufactured and assembled, and a large man-power is required to assemble the parts or elements together, such that the manufacturing cost for the electric locks or seals will be greatly increased.

The present invention has arisen to mitigate and/or obviate the afore-described disadvantages of the conventional RFID-based electric locks or seals.

SUMMARY OF THE INVENTION

The primary objective of the present invention is to provide an RFID-based electric seal using RFID technology to secure and to identify containers or other objects and including an improved structure for allowing the electric lock or seal to be easily and quickly manufactured and assembled and for suitably decreasing the manufacturing cost for the electric lock or seal.

In accordance with one aspect of the invention, there is provided an electric seal comprising a lock member including a compartment formed therein, and including an orifice formed therein and communicative with the compartment of the lock member, and including a spring blade engaged in the lock member and aligned with the orifice of the lock member, a latch device engaged in the compartment of the lock member, an antenna device engaged in the lock member and including a base member having a first segment engaged with the spring blade of the lock element, a lock shaft engageable through the orifice and into the compartment of the lock member and lockable to the lock member with the latch device, and a circuit board attached to the lock shaft and including an electric circuit, and including an RFID chip coupled to the electric circuit, the electric circuit including a contact for selectively engaging with the first segment of the base member of the antenna device and for electrically connecting the electric circuit of the circuit board to the antenna device when the lock shaft is engaged into the orifice of the lock member, the electric lock or seal may be easily and quickly manufactured and assembled for suitably decreasing the manufacturing cost for the electric lock or seal.

The lock shaft includes a bore formed therein for receiving the circuit board and a shank. The shank includes a lower portion, the circuit board includes an end portion extended beyond the shank and folded relative to the lock shaft and engaged with the lower portion of the shank.

The shank includes two depressions oppositely formed therein, and includes two projections extended in the depressions thereof respectively, and the end portion of the circuit board is engaged with the projections of the shank. The contact of the circuit board is provided on the end portion of the circuit board.

The lock shaft includes a chamber formed therein and having an inner diameter greater than that of the bore of the lock shaft, the shank includes a head engaged in the chamber of the lock shaft. The lock shaft includes a cap engaged in the chamber of the lock shaft and engaged with the head of the shank.

The lock shaft includes a sheath attached onto an outer peripheral portion of the lock shaft for covering the lock shaft. The lock member includes a seat extended therein, and the spring blade is extended from the seat. The seat of the lock member includes an inclined surface formed therein, and the antenna device includes a second segment engaged with the inclined surface of the seat of the lock element.

The lock member includes an upper wall and a partition, and the compartment of the lock member is formed between the upper wall and the partition, and the orifice is formed through the upper wall and the partition.

The latch device includes a latch member engaged in the compartment of the lock member, and the latch member includes a bore formed therein and aligned with the orifice of the lock member for receiving the lock shaft.

The latch member of the latch device includes an inner peripheral slot formed therein and communicative with the bore of the latch member, and the lock shaft includes a retaining ring for selectively engaging with the inner peripheral slot of the latch member. The lock shaft includes a collar attached thereto for engaging with a lock stem of a container or the like.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
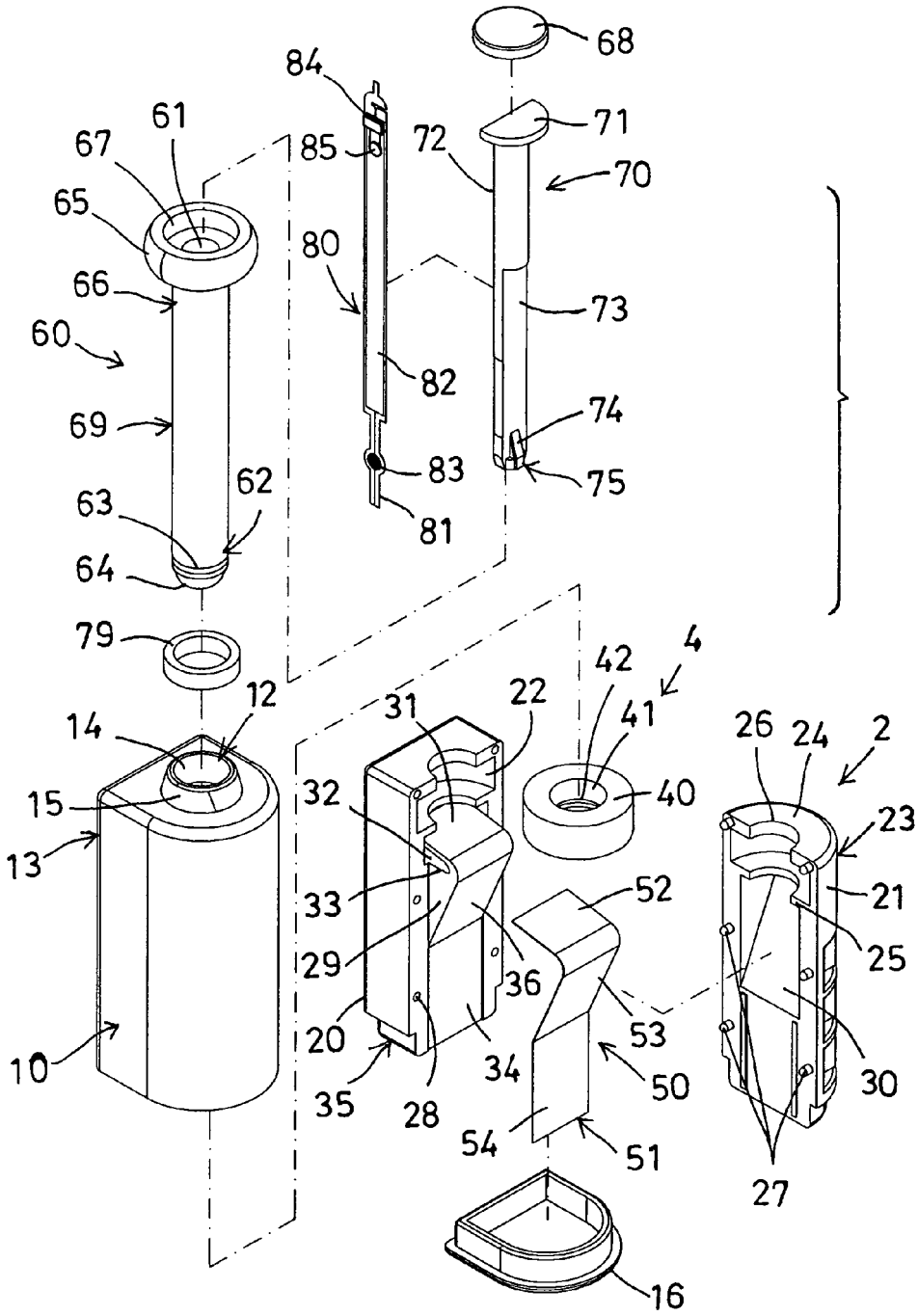
FIG. 1 is a partial exploded view of an RFID-based electric lock or seal in accordance with the present invention.

Referring to the drawings, and initially to FIGS. 1-6, an RFID-based electric seal 1 in accordance with the present invention comprises a lock body or outer housing 10 including a chamber 11 formed therein for receiving or engaging with a core or insert or lock member 2 therein, and including a peripheral fence 12 extended upwardly from the upper portion 13 thereof for forming or defining an opening 14 in the peripheral fence 12 and communicative with the chamber 11 of the housing 10, and including a tilted or inclined surface 15 formed in the outer peripheral portion of the peripheral fence 12. The lock member 2 is engaged into the chamber 11 of the housing 10 and solidly mounted or secured to the housing 10 with adhesive materials or by welding processes, or with a cover 16.

For example, the lock member 2 includes one or more (such as two) lock elements 20, 21 engaged into and retained in the chamber 11 of the housing 10, and includes a compartment 22 formed therein, such as formed in the upper portion 23 thereof and formed or defined between an upper wall 24 and a partition 25 for receiving or engaging with a latch member 40 of a latch device 4 which includes a bore 41 formed therein and aligned with or communicative with the compartment 22 of the lock member 2, and which includes an inner peripheral slot 42 formed therein and intersecting or communicative with the bore 41 of the latch member 40, the lock member 2 includes an orifice 26 formed therein, such as formed in or formed through the upper wall 24 and the partition 25, and intersecting or communicative with the compartment 22 of the lock member 2 and aligned with or communicative with the bore 41 of the latch member 40.

It is to be noted that the two lock elements 20, 21 may also be solidly mounted or secured together with such as adhesive materials or by welding processes, or with projections or catches 27 and cavities 28 that are formed in the lock elements 21, 20 respectively for forming an integral lock member 2 without the outer housing 10. The lock member 2 further includes a swelling or protrusion or anchor or seat 29 extended therein, such as extended from one of the lock elements 20 for engaging with or into a depression 30 that is formed in the other lock element 21, and further includes a spring blade 31 extended upwardly from the upper portion 32 of the seat 29 and located above the upper portion 32 of the seat 29 for forming or defining a gap or space 33 between the seat 29 and the spring blade 31, the spring blade 31 is located below or aligned with the orifice 26 of the partition 25 of the lock member 2. The lock member 2 further includes a recess 34 formed therein, such as formed in the lower portion 35 of the lock element 20 or the lock member 2. It is preferable, but not necessarily that the seat 29 is wedge-shaped having an inclined lower surface 36 formed therein.

An antenna device 50 includes a flexible plate or panel or base member 51 having an upper or first segment 52 engaged with or onto the upper portion of the spring blade 31 of the lock element 20 or the lock member 2 and located below the latch member 40 of the latch device 4, and includes a middle or intermediate or second segment 53 engaged onto or with the inclined lower surface 36 of the seat 29 of the lock element 20 or the lock member 2, and includes a lower or third segment 54 engaged into or with the recess 34 of the lock element 20 or the lock member 2, and the upper or first segment 52 of the base member 51 of the antenna device 50 is thus arranged and located below the orifice 26 of the partition 25 of the lock member 2.

A lock shaft 60 includes a slit or bore 61 formed therein for receiving or engaging with a shank 70 and a circuit board 80 therein, and includes a lower portion 62 for selectively engaging into the opening 14 in the peripheral fence 12 of the housing 10 and into the bore 41 of the latch member 40, and includes a clamping or retaining ring 63 attached or mounted or secured to the lower portion 62 of the lock shaft 60 for selectively engaging with the inner peripheral slot 42 of the latch member 40 and for solidly or stably locking or retaining the lock shaft 60 in the opening 14 of the peripheral fence 12 of the housing 10 and in the bore 41 of the latch member 40 and/or in the compartment 22 or the orifice 26 of the lock member 2, and includes a tilted or tapered or inclined portion 64 formed or provided on the lower portion 62 thereof for allowing the lower portion 62 of the lock shaft 60 to be guided to easily engage into the opening 14 of the peripheral fence 12 of the housing 10 and then into the bore 41 of the latch member 40.

The lock shaft 60 further includes an enlarged head 65 formed or provided on the upper portion 66 thereof, and includes a chamber 67 formed in the head 65 and having an inner diameter greater than that of the bore 61 of the lock shaft 60 for receiving or engaging with a cap 68 which may be provided for blocking or sealing the upper portion of the bore 61 of the lock shaft 60 and for stably anchoring or positioning or retaining the shank 70 and the circuit board 80 in the bore 61 of the lock shaft 60. The shank 70 also includes an enlarged head 71 formed or provided on the upper portion thereof and also received or engaged in the chamber 67 of the head 65 of the lock shaft 60 and solidly or stably locked or retained or clamped between the head 65 and the cap 68.

The shank 70 includes one or more (such as two) cut off portions or depressions 72, 73 oppositely formed therein, and includes one or more (such as two) projections 74 extended therefrom, such as oppositely extended from the lower portion 75 thereof and extended from or located in the cut off portions or depressions 72, 73 thereof respectively. The circuit board 80 is attached or mounted or secured to and engaged with the depression 72 of the shank 70, and includes a lower end portion 81 extended out or beyond the shank 70 and bent or folded relative to the lock shaft 60 and engaged with the other depression 73 of the shank 70, and also engaged with or around the projections 74 of the shank 70, or engaged with or around the lower portion 75 of the shank 70, and includes an electric circuit 82 printed or applied or attached onto the circuit board 80, and includes a contact 83 formed or provided on the lower portion 81 thereof and located below the lower portion 75 of the shank 70 for selectively engaging with the antenna device 50 and for selectively and electrically coupling or connecting the electric circuit 82 to the antenna device 50.

The circuit board 80 further includes an RFID chip 84 and one or more batteries 85 attached or mounted or coupled or connected to the electric circuit 82 for identifying the identity of the RFID-based electric seal 1 when the electric circuit 82 is electrically coupled or connected to the antenna device 50. It is to be noted that the contact 83 of the electric circuit 82 of the circuit board 80 will be engaged onto the upper or first segment 52 of the base member 51 of the antenna device 50 and will also be engaged onto the spring blade 31 which may selectively bias and force the antenna device 50 to selectively and electrically or suitably engage with the contact 83 of the electric circuit 82 of the circuit board 80.

Figure 7:
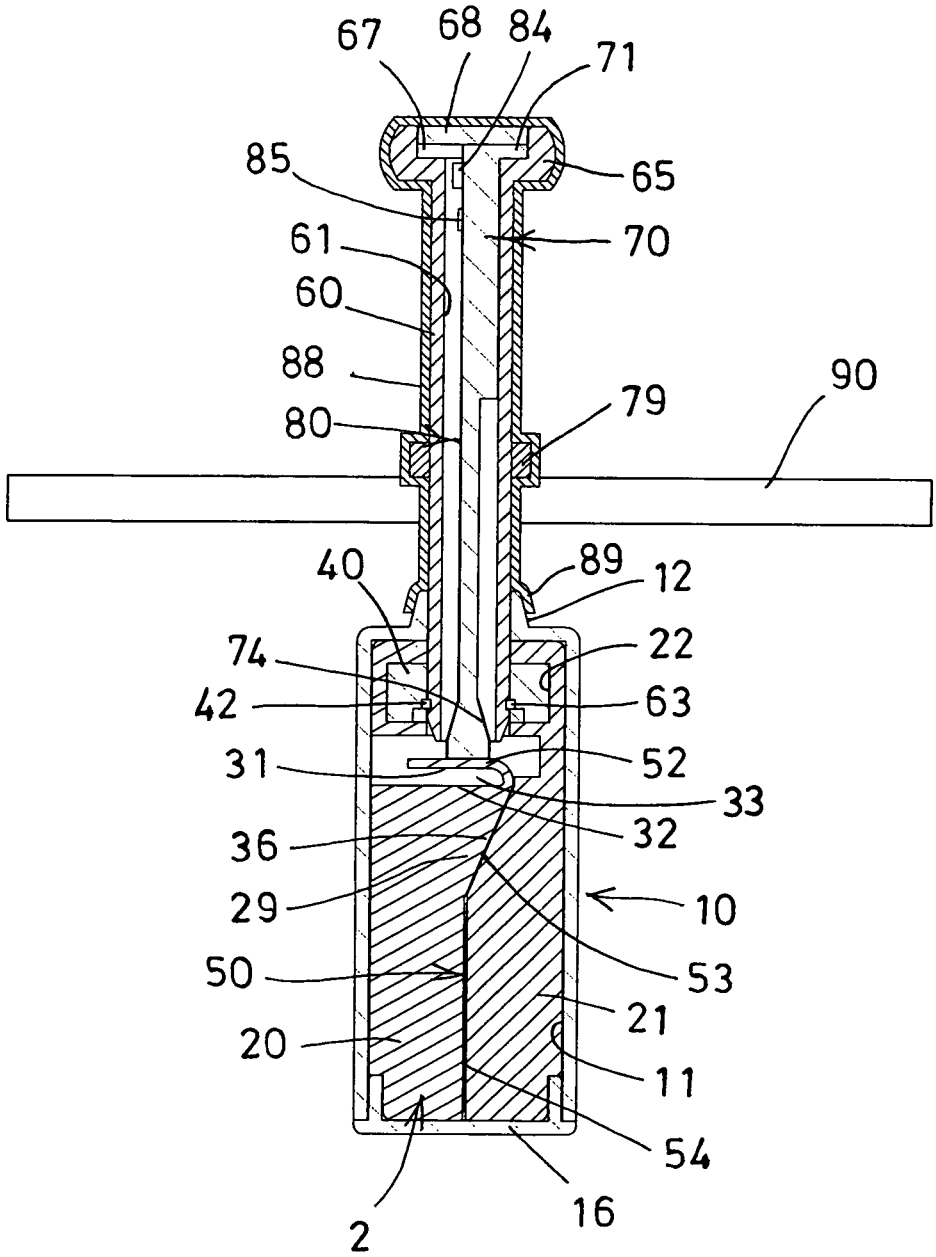
FIGS. 7, 8 are further cross sectional views similar to FIG. 6, illustrating the operation of the RFID-based electric seal.
Figure 8:
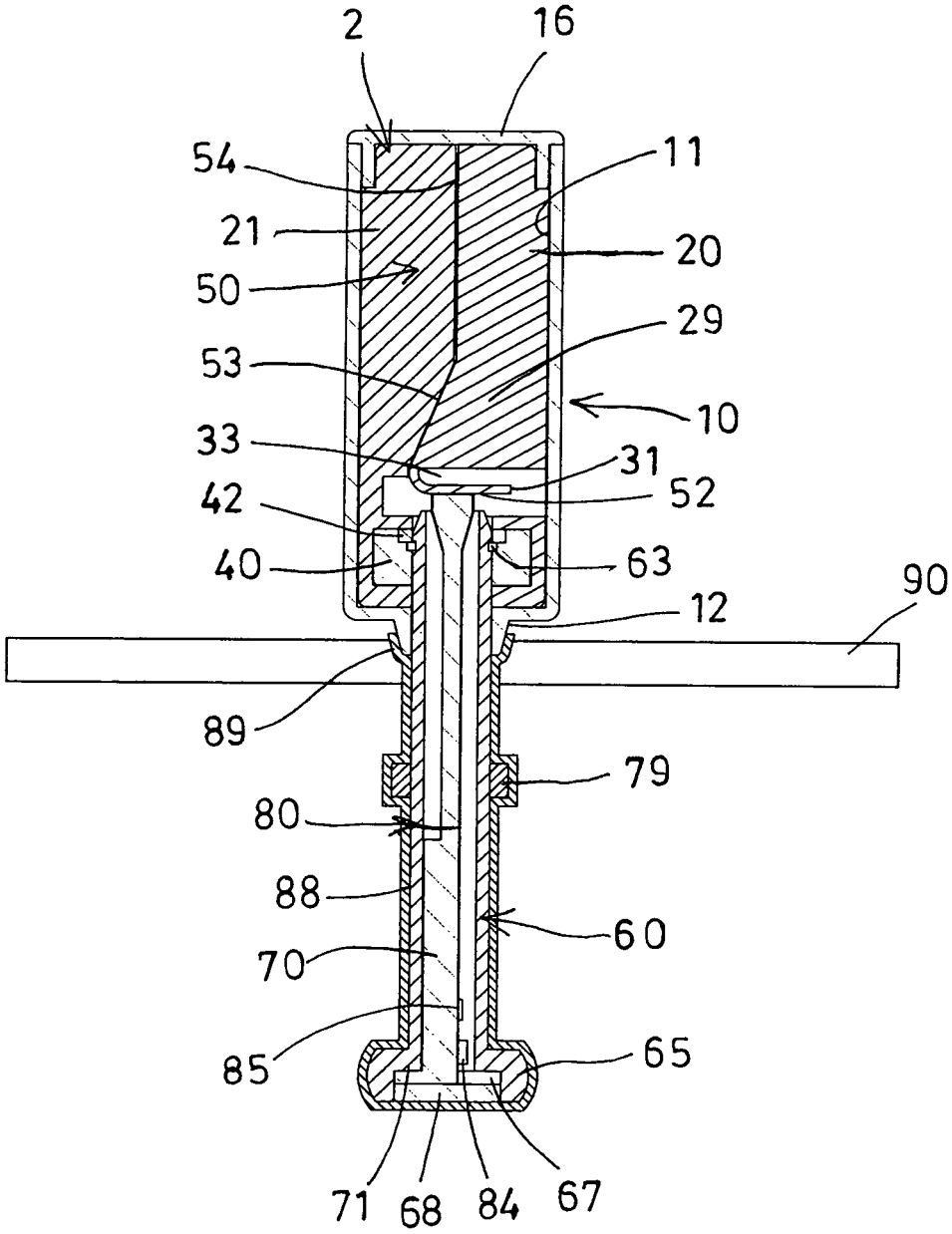

It is preferable, but not necessarily that the lock shaft 60 further includes an outer covering or sheath 88 applied or attached onto the outer peripheral portion of the upper portion 66 of the lock shaft 60 (FIGS. 2-3 and 5-8) for further blocking or sealing or covering the upper portion of the bore 61 of the lock shaft 60 and for preventing the humidity or liquid or water from entering into the bore 61 of the lock shaft 60 and for suitably protecting the circuit board 80 from being damaged by the humidity or liquid or water. The outer covering or sheath 88 includes a radially and outwardly extended lower peripheral skirt 89 for engaging with the inclined surface 15 of the peripheral fence 12 of the housing 10 and for firmly and sealingly engaged with the housing 10. A collar 79 may further be provided and attached or mounted or secured to the middle portion 69 of the lock shaft 60 and engaged in the sheath 88 and solidly or stably anchored or secured or retained to the lock shaft 60 with the sheath 88 for engaging with a lock stem 90 (FIGS. 7, 8).

Figure 2:
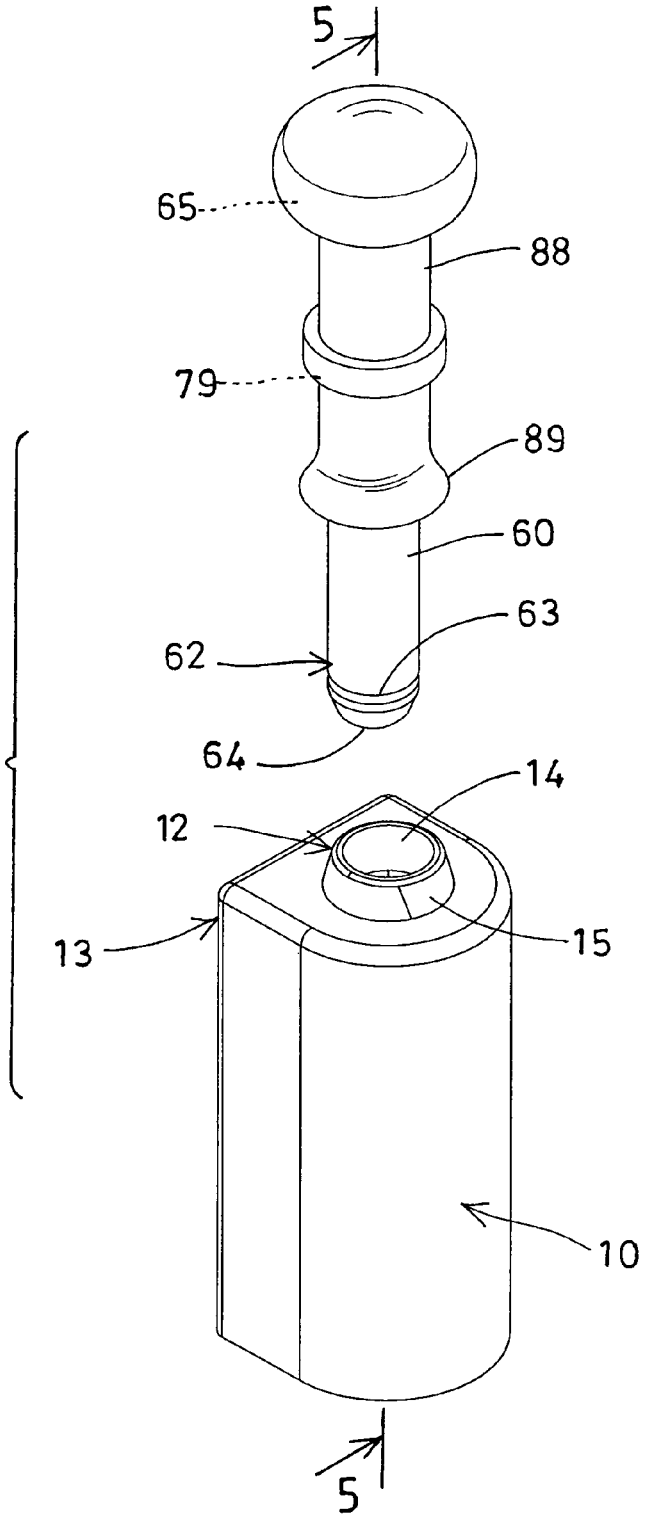
FIG. 2 is another partial exploded view of the RFID-based electric lock or seal.
Figure 3:
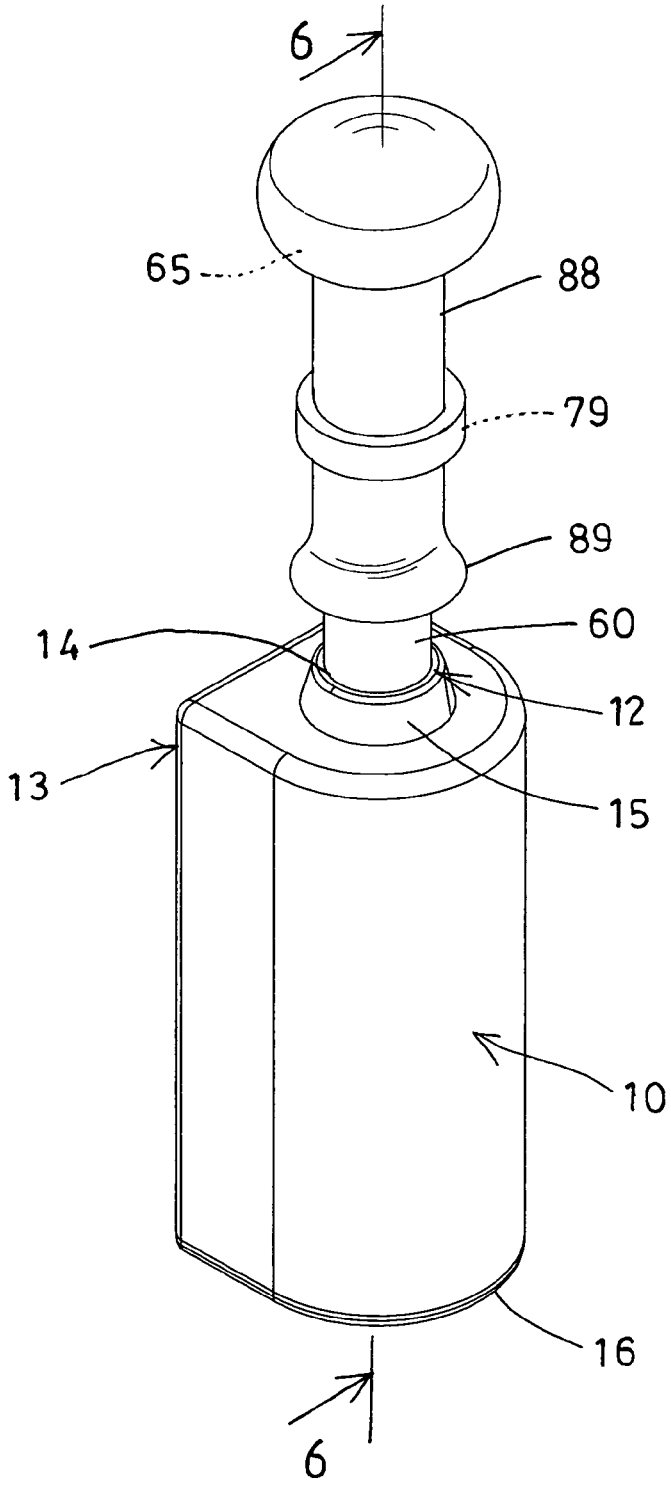
FIG. 3 is a perspective view of the RFID-based electric lock or seal.
Figure 4:
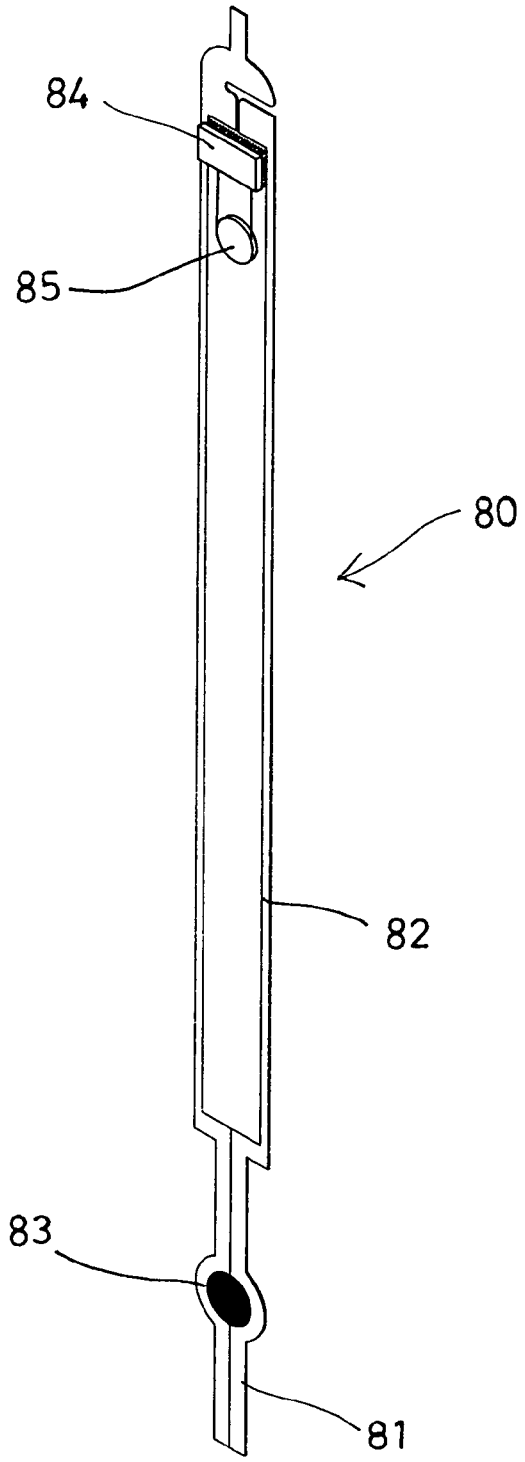
FIG. 4 is a perspective view illustrating a circuit board of the RFID-based electric lock or seal.
Figure 5:
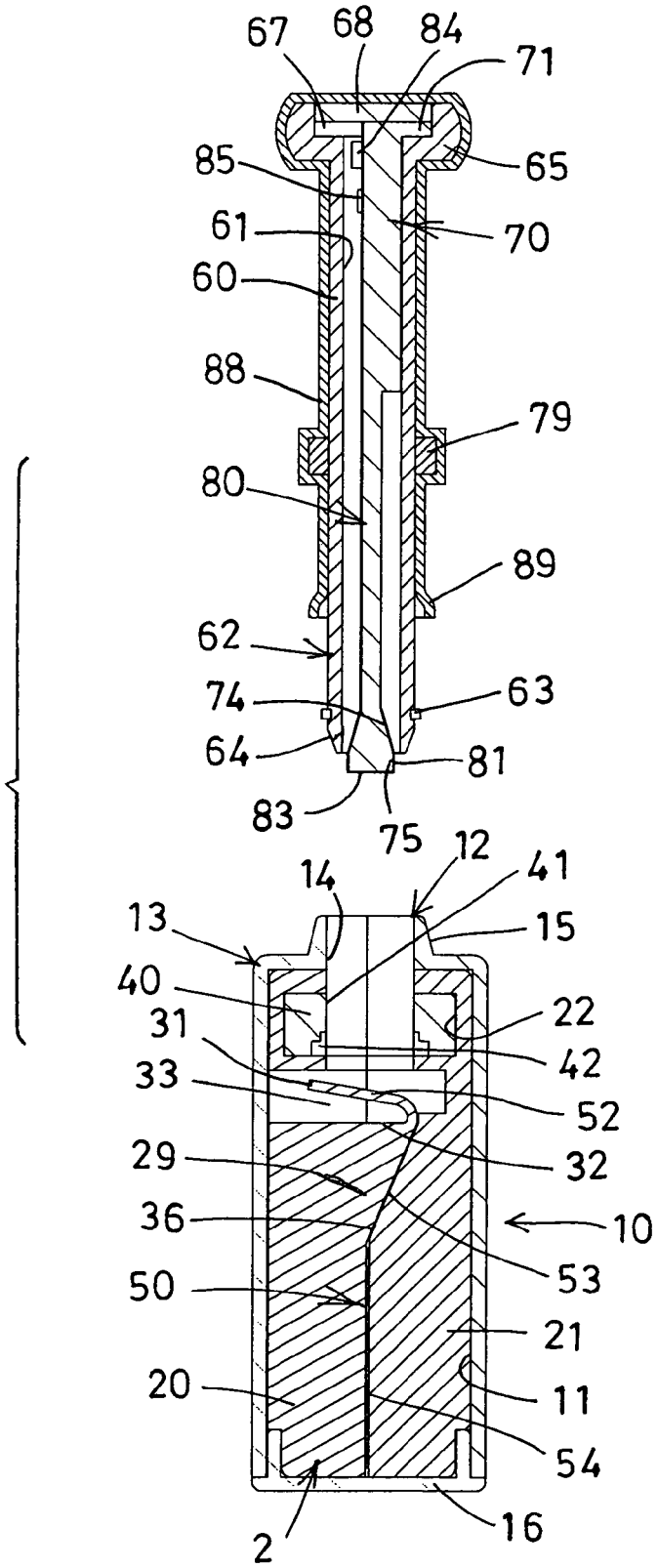
FIG. 5 is a cross sectional view of the RFID-based electric lock or seal, taken along lines 5-5 of FIG. 2.
Figure 6:
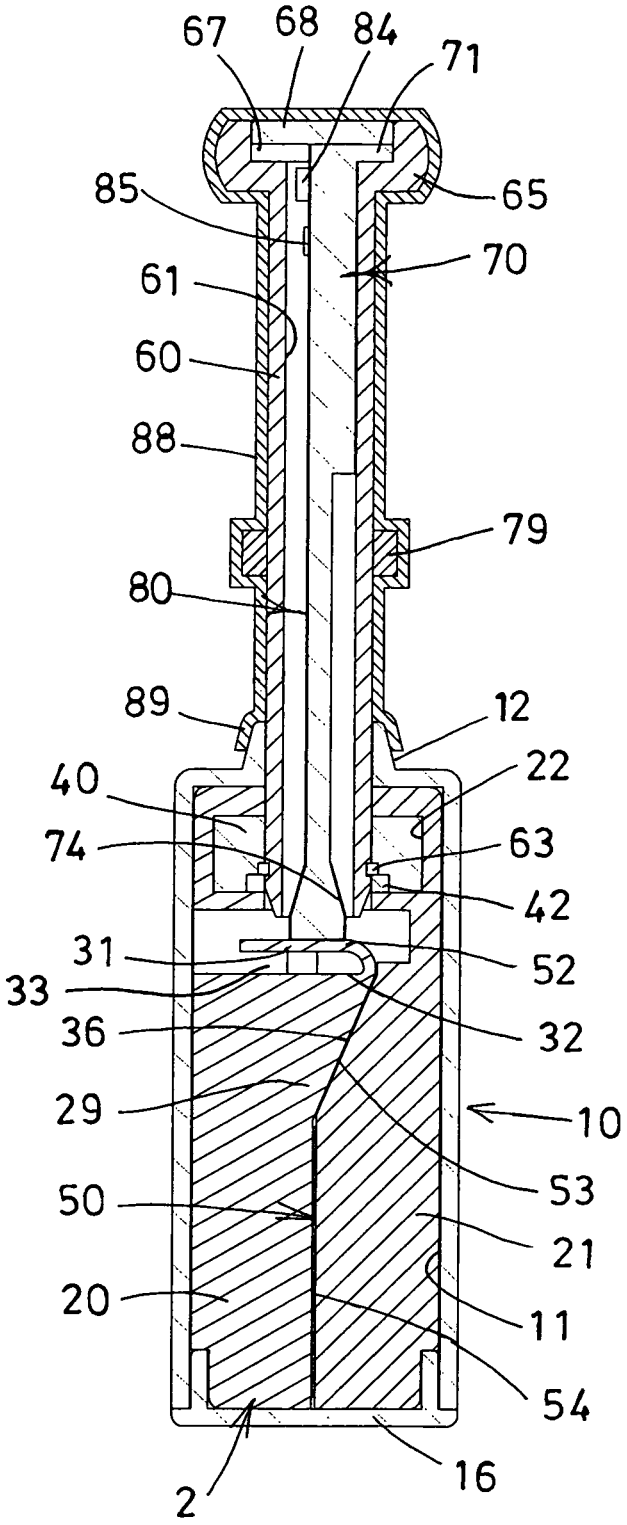
FIG. 6 is another cross sectional view of the RFID-based electric lock or seal, taken along lines 5-5 of FIG. 3.

In operation, as shown in FIGS. 2 and 5, the lock shaft 60 is separated from the housing 10 and may be selectively engaged into the opening 14 of the peripheral fence 12 or of the housing 10, and then engaged into the bore 41 of the latch member 40 and/or the compartment 22 of the lock member 2 until the retaining ring 63 is engaged with the inner peripheral slot 42 of the latch member 40 (FIGS. 3 and 6-8) and thus for stably anchoring or positioning or retaining or locking the lock shaft 60 to the lock member 2 or the housing 10, the upper or first segment 52 of the base member 51 of the antenna device 50 may be biased and forced to engage with the contact 83 of the electric circuit 82 of the circuit board 80 with the spring biasing force of the spring blade 31, and the RFID chip 84 may be used to generate or emit a signal to identify the identity of the RFID-based electric seal 1. The lock shaft 60 may be engaged through the lock stem 90 (FIGS. 7, 8) of a container (not shown) or the like before engaged into the opening 14 of the peripheral fence 12 or of the housing 10.

When the lock shaft 60 is disengaged from the lock member 2 or the housing 10, or when the contact 83 of the electric circuit 82 of the circuit board 80 is disengaged from the upper or first segment 52 of the antenna device 50 of the lock member 2 or of the housing 10, the electric circuit 82 of the circuit board 80 will be switched off and the RFID chip 84 may no longer be used to generate or emit the signal to identify the identity of the RFID-based electric seal 1, such that a remote control center (not shown) may realize or know that the lock shaft 60 has been disengaged from the lock member 2 or the housing 10, or that the RFID-based electric seal 1 has been damaged by unauthorized persons. The contact 83 of the electric circuit 82 of the circuit board 80 may also be directly attached to the lower portion 62 of the lock shaft 60 for engaging with the upper or first segment 52 of the antenna device 50.

Figure 9:
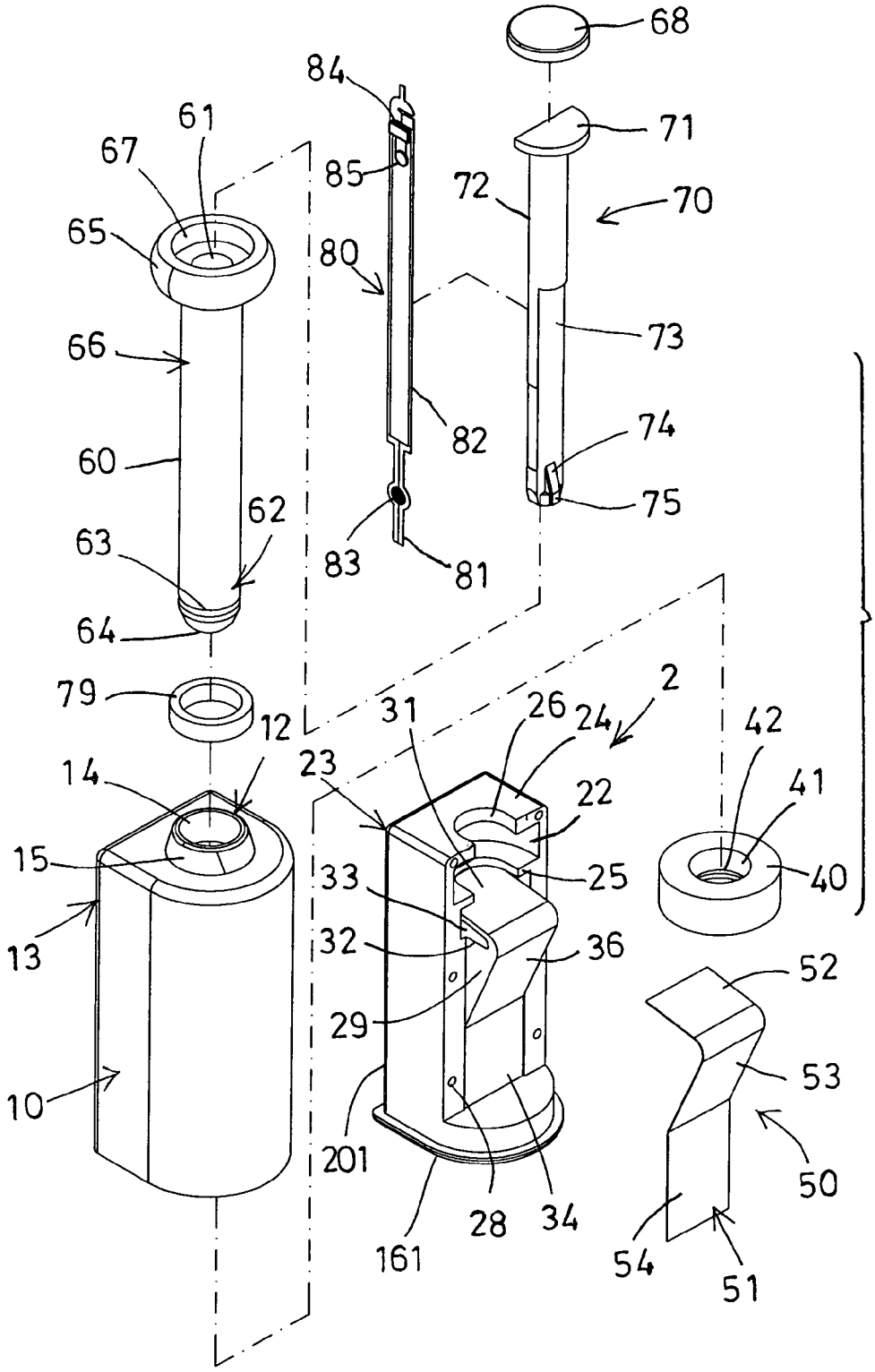
FIG. 9 is another partial exploded view illustrating the other arrangement of the RFID-based electric seal.

Alternatively, as shown in FIG. 9, the lock element 201 of the lock member 2 may include the cover 161 solidly attached or mounted or secured to the lower or bottom portion thereof, and the antenna device 50 may be directly printed or applied or attached onto the seat 29 and the spring blade 31 of the lock element 201, without the other lock element 21 that are shown in FIGS. 1 and 5-8.

Accordingly, the RFID-based electric seal in accordance with the present invention includes an improved structure for allowing the electric lock or seal to be easily and quickly manufactured and assembled and for suitably decreasing the manufacturing cost for the electric lock or seal.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric seal comprising:

a lock member including a compartment formed therein, and including an orifice formed therein and communicative with said compartment of said lock member, and including a spring blade engaged in said lock member and aligned with said orifice of said lock member, a latch device engaged in said compartment of said lock member, an antenna device engaged in said lock member and including a base member having a first segment engaged with said spring blade of said lock element, a lock shaft engageable through said orifice and into said compartment of said lock member and lockable to said lock member with said latch device, and a circuit board attached to said lock shaft and including an electric circuit, and including an RFID chip coupled to said electric circuit, said electric circuit including a contact for selectively engaging with said first segment of said base member of said antenna device and for electrically connecting said electric circuit of said circuit board to said antenna device when said lock shaft is engaged into said orifice of said lock member.

2. The electric seal as claimed in claim 1, wherein said lock shaft includes a bore formed therein for receiving said circuit board and a shank.

3. The electric seal as claimed in claim 2, wherein said shank includes a lower portion, said circuit board includes an end portion extended beyond said shank and folded relative to said lock shaft and engaged with said lower portion of said shank.

4. The electric seal as claimed in claim 3, wherein said shank includes two depressions oppositely formed therein, and includes two projections extended in said depressions thereof respectively, and said end portion of said circuit board is engaged with said projections of said shank.

5. The electric seal as claimed in claim 3, wherein said contact of said circuit board is provided on said end portion of said circuit board.

6. The electric seal as claimed in claim 2, wherein said lock shaft includes a chamber formed therein and having an inner diameter greater than that of said bore of said lock shaft, said shank includes a head engaged in said chamber of said lock shaft.

7. The electric seal as claimed in claim 6, wherein said lock shaft includes a cap engaged in said chamber of said lock shaft and engaged with said head of said shank.

8. The electric seal as claimed in claim 1, wherein said lock shaft includes a sheath attached onto an outer peripheral portion of said lock shaft for covering said lock shaft.

9. The electric seal as claimed in claim 1, wherein said lock member includes a seat extended therein, and said spring blade is extended from said seat.

10. The electric seal as claimed in claim 9, wherein said seat of said lock member includes an inclined surface formed therein, and said antenna device includes a second segment engaged with said inclined surface of said seat of said lock element.

11. The electric seal as claimed in claim 1, wherein said lock member includes an upper wall and a partition, and said compartment of said lock member is formed between said upper wall and said partition, and said orifice is formed through said upper wall and said partition.

12. The electric seal as claimed in claim 11, wherein said latch device includes a latch member engaged in said compartment of said lock member, and said latch member includes a bore formed therein and aligned with said orifice of said lock member for receiving said lock shaft.

13. The electric seal as claimed in claim 12, wherein said latch member of said latch device includes an inner peripheral slot formed therein and communicative with said bore of said latch member, and said lock shaft includes a retaining ring for selectively engaging with said inner peripheral slot of said latch member.

14. The electric seal as claimed in claim 1, wherein said lock shaft includes a collar attached thereto.

* * * * *